US006386391B2

(12) United States Patent
Vezzani

(10) Patent No.: US 6,386,391 B2
(45) Date of Patent: May 14, 2002

(54) METERING MACHINE FOR PASTA

(75) Inventor: Paolo Vezzani, Capannori (IT)

(73) Assignee: Studio Tecnico Per. Ind. Giuseppe Vezzani, Montecatini Terme (IT)

( * ) Notice: Subject to any disclaimer, the term of this patent is extended or adjusted under 35 U.S.C. 154(b) by 0 days.

(21) Appl. No.: 09/795,394

(22) Filed: Mar. 1, 2001

(30) Foreign Application Priority Data

Mar. 2, 2000 (IT) ..... MI00A0411

(51) Int. Cl.[7] ..... G01F 11/10
(52) U.S. Cl. ..... 222/77; 222/196; 222/368
(58) Field of Search ..... 222/77, 363, 196, 222/368

(56) References Cited

U.S. PATENT DOCUMENTS 2,976,006 A * 3/1961 Stambera ..... 222/445
3,135,343 A * 6/1964 Stambera ..... 177/1
3,145,742 A * 8/1964 Miller et al. ..... 222/135
3,593,813 A * 7/1971 Kitaba et al. ..... 177/82
3,774,818 A * 11/1973 Alexandrov et al. ..... 222/368
4,610,322 A * 9/1986 Sugioka et al. ..... 177/1
4,906,144 A * 3/1990 Matsueda ..... 222/368
5,108,012 A * 4/1992 Rosso ..... 222/200
5,150,758 A * 9/1992 Gmuer ..... 177/165
5,340,269 A * 8/1994 Caridis et al. ..... 177/25.18
5,743,639 A * 4/1998 Puerner et al. ..... 222/226

FOREIGN PATENT DOCUMENTS

FR 2104954 A 4/1972
WO WO 93 17912 A 9/1993

* cited by examiner

*Primary Examiner*—Kenneth Bomberg
(74) *Attorney, Agent, or Firm*—Pillsbury Winthrop LLP

(57) ABSTRACT

A metering machine for pasta is described comprising at least one channel for the roughing of the pasta, a shovel that is transversally insertable in said channel in order to meter the pasta, a cylinder with radial cavity rotatable between a position for the support of the pasta present in said channel and a position for the collection of the pasta in said radial cavity, at least one basket for the collection of the pasta output by said cylinder and a weighing device for the pasta being collected in said basket. The cylinder is made rotate around an eccentric axis that is arranged in such a way that said cylinder when in position of support is at a higher level than the one in which it gets when in said position for the collection of the pasta.

6 Claims, 8 Drawing Sheets

METERING MACHINE FOR PASTA

The present invention refers to a metering machine for pasta, in particular for long cut pasta.

Generally there are known industrial machines suitable for the packaging of pasta. Naturally the same pasta before the packaging must be appropriately weighed by means of metering machines so as to establish and to control the quantity required for the packaging.

Generally said metering machines are provided with roughing and finishing channels, in which metering shovels that set the amount of pasta to be delivered each time to the packaging machine are inserted transversally.

In the case of long cut pasta the metering that is carried out in the roughing channel, where the weight of the pasta present therein is greater, is often accompanied by an undesired breaking of the pasta due to the action of the shovel, that compresses and breaks the pasta.

In view of the state of the art herein described, scope of the present invention is to present a metering machine for long cut pasta that is free of the aforementioned disadvantage.

According to the present invention, such scope is attained by means of a metering machine for pasta comprising at least one channel for the roughing of the pasta, a shovel that is transversally insertable in said channel in order to meter the pasta, a cylinder with radial cavity that is rotatable between a position for the support of the pasta present in said channel and a position for the collection of the pasta in said radial cavity, at least one basket for the collection of the pasta output by said cylinder and a device for the weighing of the pasta being collected in said basket, characterised in that said cylinder is made rotate around an eccentric axis that is arranged in such a way that said cylinder when in support position is at a higher level than the one in which it is when in said position for the collection of the pasta.

Owing to the present invention it is possible to realise a metering machine for long cut pasta in which the eccentric rotation of the cylinder from said position of support to said position of collection, allows the same pasta to accept the movement of the insertion of the metering shovel without breaking.

The characteristics and the advantages of the present invention will become evident from the following detailed description of an embodiment thereof, that is illustrated as a non-limiting example in the enclosed drawings, in which.

Figure 1:
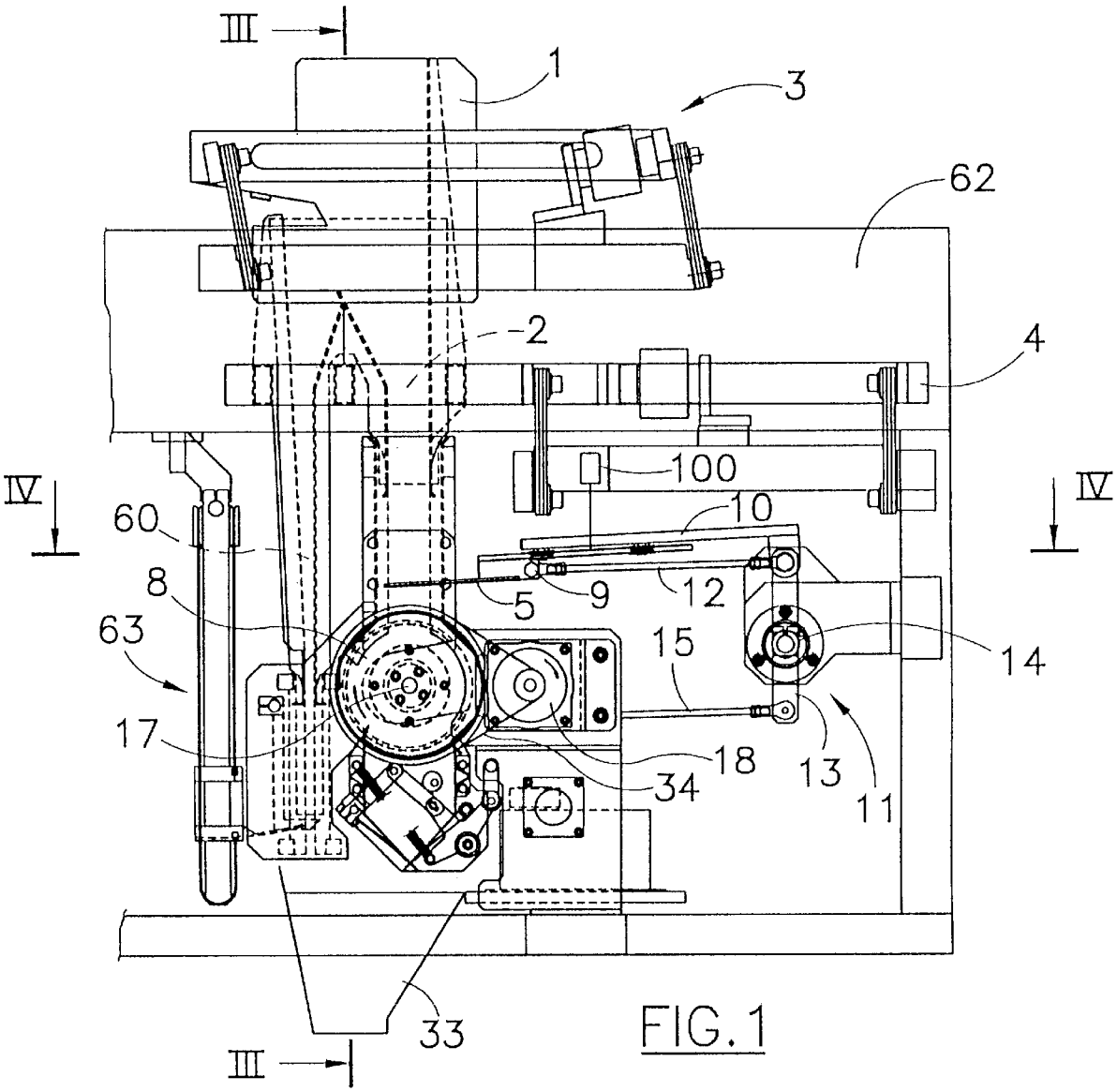
FIG. 1 is a front view of the metering machine according to the present invention.
Figure 2:
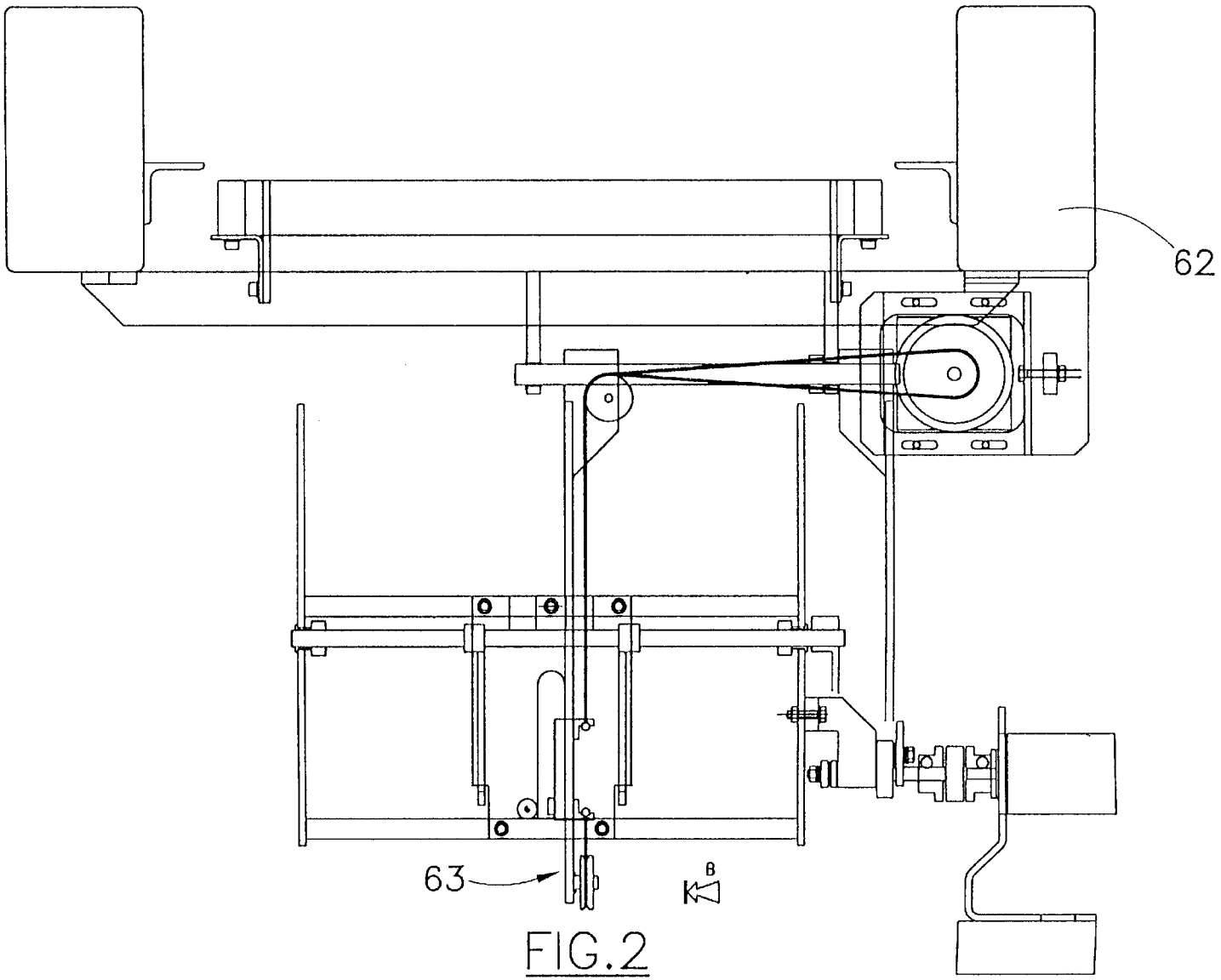
FIG. 2 is a side view from the left of the metering machine in FIG. 1.
Figure 3:
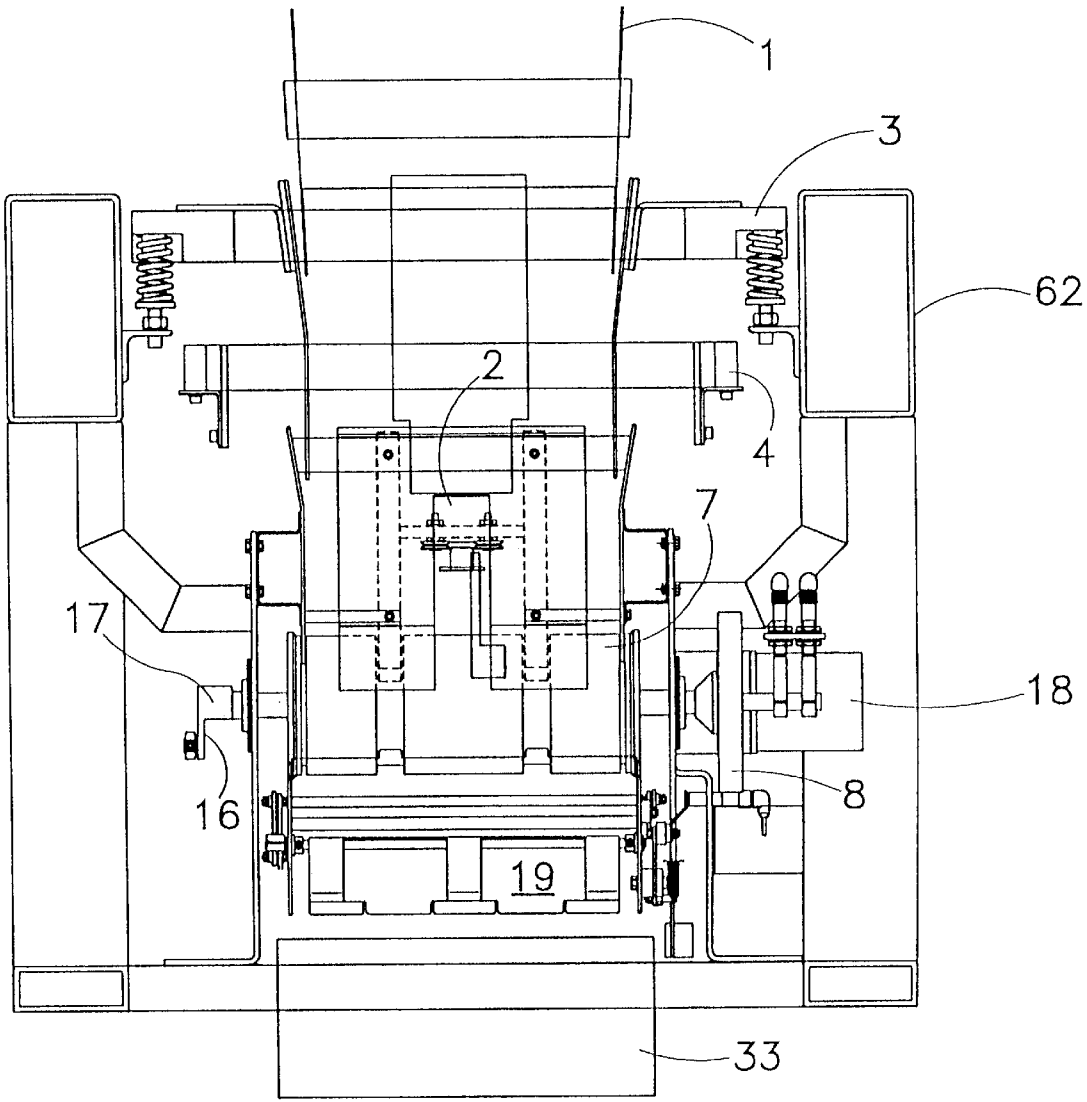
FIG. 3 is a section according to the line III—III of the machine in FIG. 1.
Figure 4:
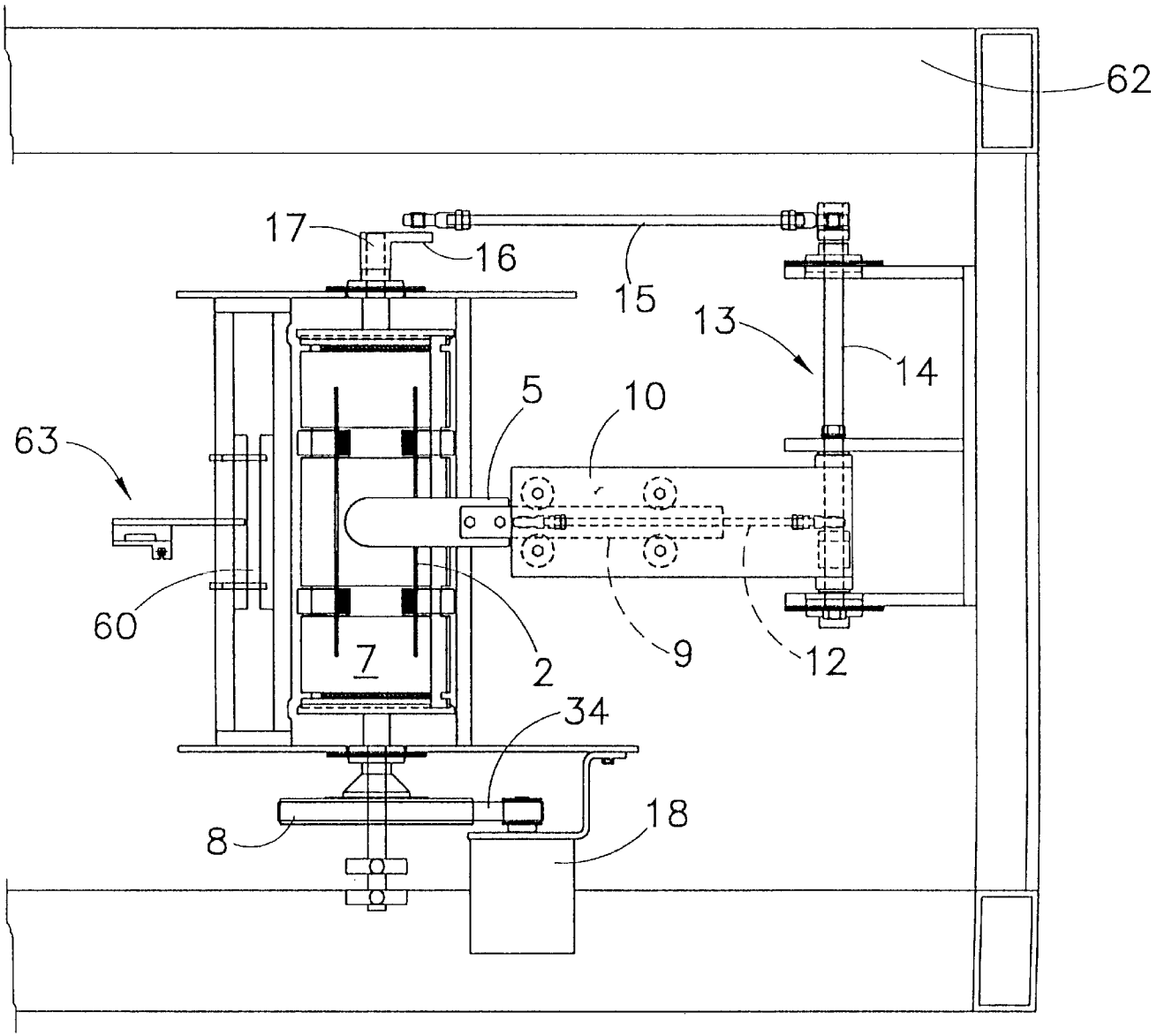
FIG. 4 is a section according to the line IV—IV of the machine in FIG. 1.

With reference to FIGS. 1–4 a metering machine according to the present invention is shown in which the product, that is long cut pasta, for instance spaghetti, is introduced through a mouth 1 into a roughing channel 2 by means of oscillations caused by a vibrating device 3 that is arranged on the upper part of the machine. The channel 2 is a channel for the descent of the product for the roughing of the same and it is connected with a second vibrating device 4 in order to facilitate the descent of the pasta in the channel. Next to the roughing channel 2 a finishing channel 60 is arranged (FIGS. 1 and 2) with relative device for the final metering 63.

The pasta that flows into channel 2 undergoes an operation of metering carried out by means of an appropriate meter that is made up of a shovel 5 horizontally movable and connected with a cylinder 7 with radial cavity 61 and central axis C, that is rotatable around an axis defined by a shaft 17 orthogonal to the sheet in FIG. 1 and fixedly mounted to a pulley 8. As shown more in detail in FIGS. 1 and 4–7, the shovel 5 is connected with a body 9 that is movable horizontally on a horizontal guide 10 connected with the frame 62 of the machine and is reclinable under the action of a motor 100 supported by the same frame. The body 9 is moved horizontally by means of an appropriate leverage 11 connected with the eccentric cylinder 7; more precisely such leverage 11 comprises a first arm 12 hinged in one end to the body 9 and in the other end to a lever 13 that is hinged on a pin 14 held by the frame 62 of the machine. The other end of the lever 13 is hinged to an end of a second arm 15 that is in turn hinged at the other end to a small lever 16 that is fixedly mounted to the rotation shaft 17 of the cylinder 7. The latter rotates under the action of the pulley 8 connected through a belt 34 to a stepper motor 18.

Below the cylinder 7 a basket 19 is arranged that is fastened to a weigh meter 20 in order to carry out the weighing of the pasta, as shown more in detail in FIGS. 8–11. The basket 19 is made up of a structure comprising a hollow parallelepiped 21 that is closed on the bottom by two doors 22, 23 of which the first one is hinged in 64 on the bottom part of one side of the parallelepiped 21, while the second is revolvingly hinged in 25 on the opposite side of the parallelepiped 21. A T-lever 27 hinged in 28 on said opposite side of the parallelepiped 21, is connected through a small lever 29 with a lever 24 fixedly mounted to the hinge 64 and through one spring 30 to the other side of the parallelepiped 21. A similar leverage 50, 51, 52 is present on the opposite side of the basket 19 in such a way that the door 23 is fixed to a lever 52 that is symmetrical to the T-lever 27, and the rotation of the lever 52 is controlled by a lever 50 fixedly mounted to the hinge 64 of the first door 22 through a lever 51 hinged to the ends of levers 50, 52. A connecting rod 31 hinged in 67 and connected by a tie rod 66 to a crank 65 set in action by a stepper motor 32 provides to the opening of the basket 19 and precisely to the downward rotation of the door 22, and consequently of the door 23 by means of the leverage 50, 51, 52, while the spring 30 provides to the closing of the basket by means of rotation upward of the doors 22, 23.

Below the basket 19 a hopper 33 for the output of the pasta from the metering machine is placed.

The operation of the machine provides for the aforesaid operations of metering and weighing.

Figure 5:
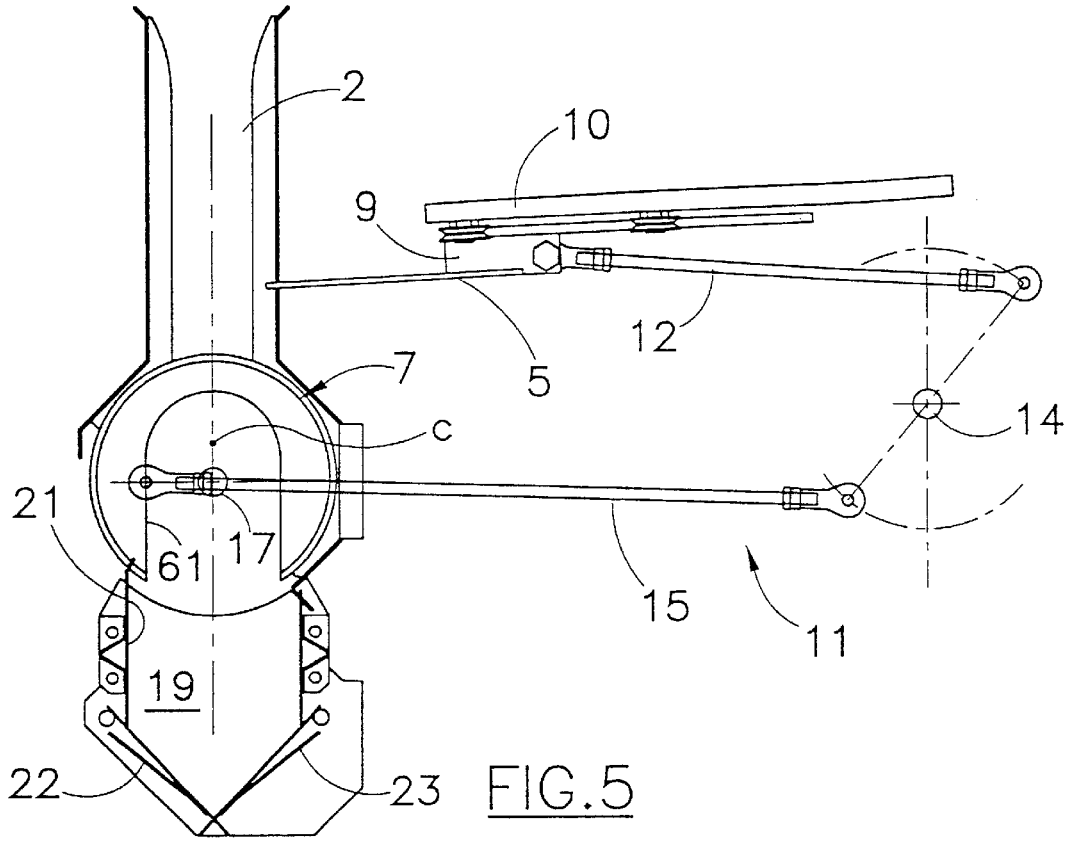
FIGS. 5, 6, 7 show the various stages of the metering operation of the pasta in the roughing channel of the machine in FIG. 1.
Figure 6:
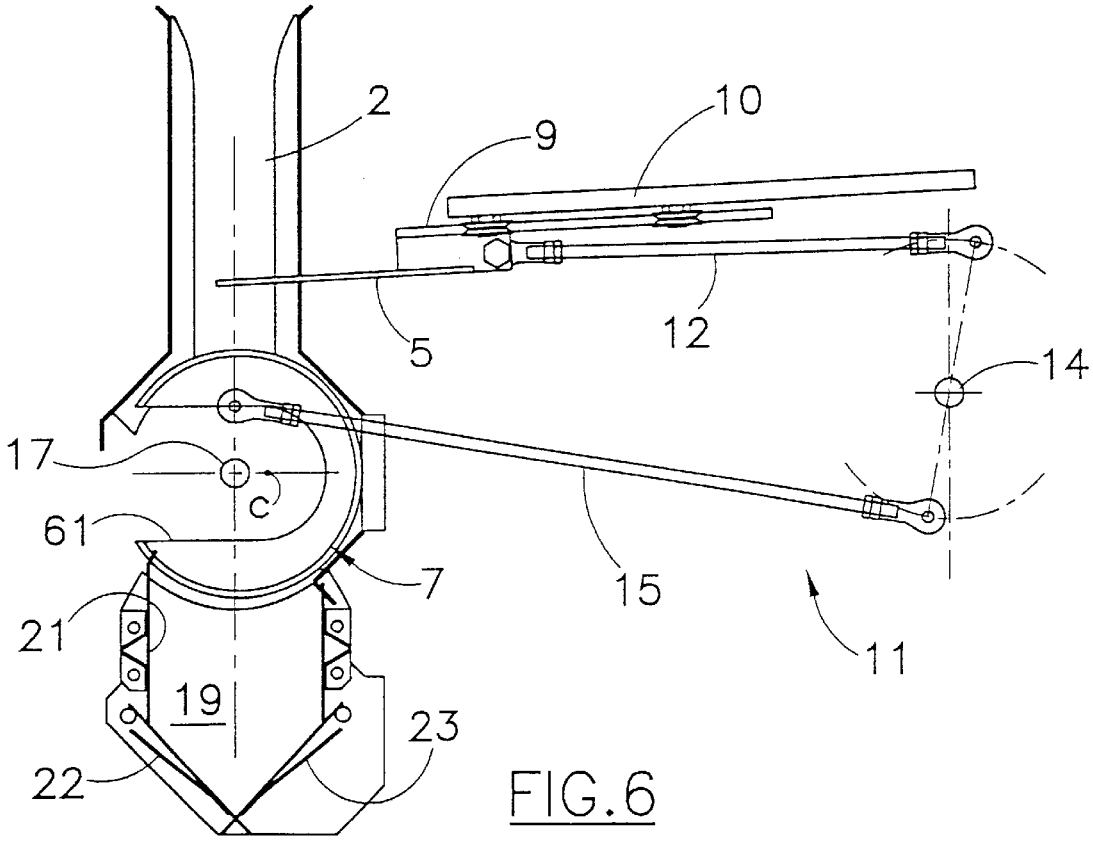
Figure 7:
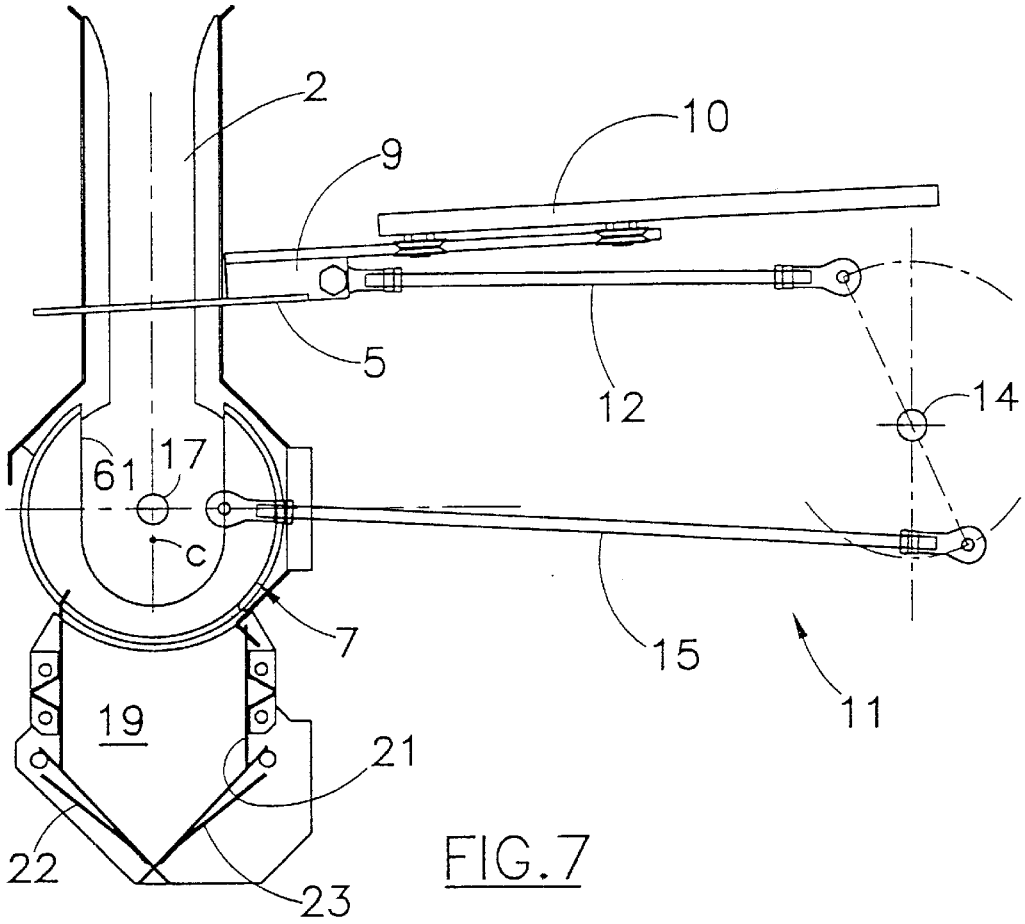

The metering operation is carried out in a sequence of stages that are shown in FIGS. 5–7 in which the cylinder 7 having one axis in C with a given eccentricity as regards the rotation shaft 17, rotates clockwise starting from the position of support of the pasta in FIG. 5 under the action of the stepper motor 18 connected to the pulley 8 through the belt 34. The rotation of the cylinder 7 consequently causes a movement towards the right of the arm 15 and a movement towards the left of the arm 12 in such a way that the shovel 5 enters transversally into the channel 2. The shovel 5 starts compressing the pasta contained in the channel 2 but the eccentric rotation of cylinder 7 allows the latter to position itself in such a way that the pasta below the shovel 5 lowers itself thus preventing the latter to determine damaging effects for the same pasta. When the cylinder 7 reaches the position in FIG. 7, the pasta slides inside its radial cavity 61. In a subsequent stage, with the cylinder rotated by 180° as regards the position of support of FIG. 5, the pasta inside the cylinder 7 is discharged inside the basket 19 in order to provide to its weighing.

The weighing operation is carried out with the basket closed and free of any engagement with the connecting rod 31 that is arranged at a distance from the basket 19. The weigh meter 20, connected at its top with the basket 19 by means of a bracket 40, emits an electronic signal corresponding to the weighing having been carried out that opportunely sets in action the fine metering device 63 associated with the finishing channel 60.

Figure 8:
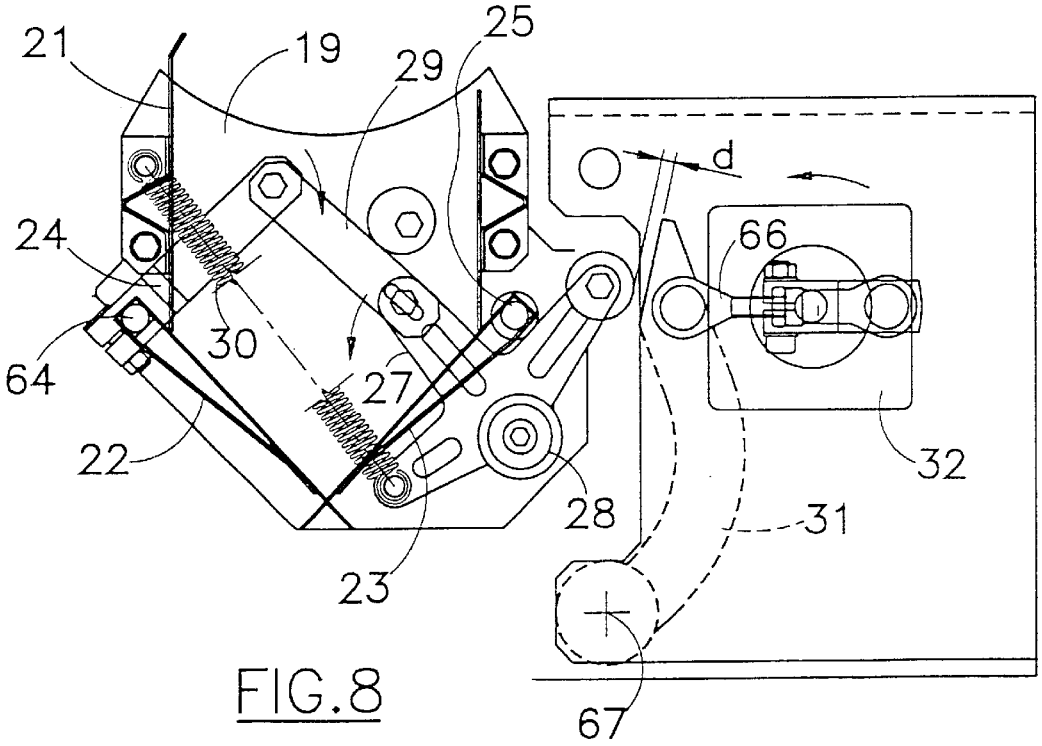
FIG. 8 is a front view of the basket for the collection of the pasta in a closing position with a mechanism assigned to its opening and closing.
Figure 9:
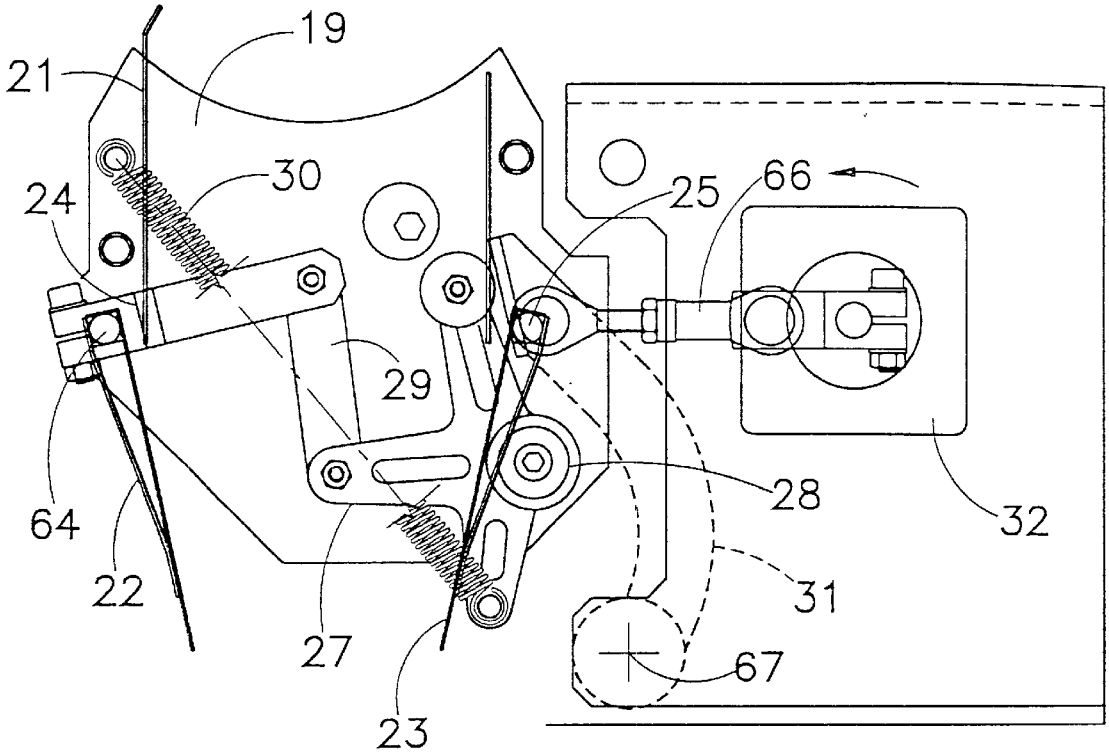
FIG. 9 is similar to FIG. 8 but with the basket in opening position.
Figure 10:
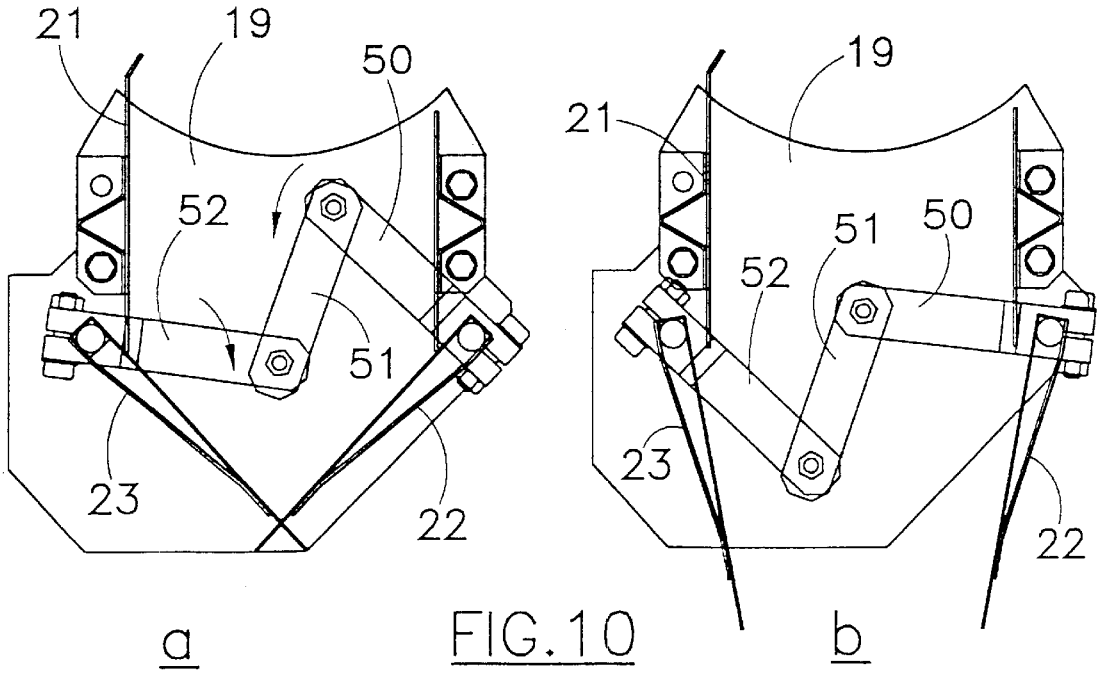
FIG. 10 is a view of the basket for the collection of the pasta in closing (a) and opening (b) position.
Figure 11:
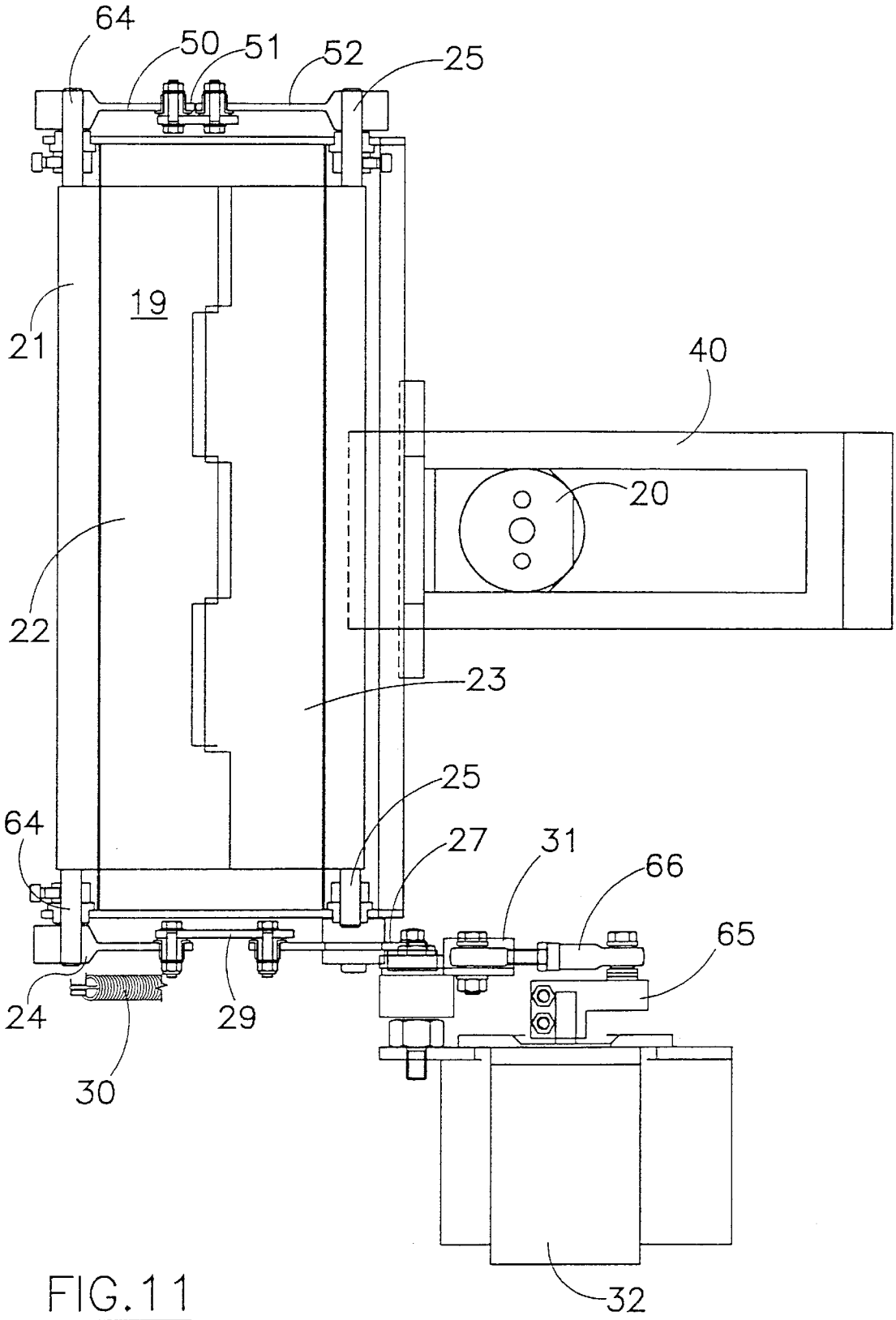
FIG. 11 is a top view of the basket in FIG. 8 in combination with a weighing device and a device for the opening of the basket that is controlled by said weighing device.

Because of such electronic signal the basket 19 is opened under the action of the stepper motor 32 that pushes the connecting rod 31 horizontally towards the left as regards FIG. 8. The connecting rod 31 in turn operates on one end of the T-lever 27 so as to cause its counter-clockwise rotation and a consequent rotation of the small levers 29 and 24. The door 22 thus undergoes a clockwise opening rotation and consequently by means of the leverage 50, 51, 52 the door 23 undergoes a counter-clockwise opening rotation; the pasta contained in the basket therefore falls into the hopper 33.

The closing of the basket 19 takes place with a recovery of the connecting rod 31 in its rest position and a consequent closing rotation of the doors 22 and 23 under the action of the spring 30.

What is claimed is:

1. Metering machine for pasta comprising at least one channel for the roughing of the pasta, a shovel that is transversally insertable in said channel in order to meter the pasta, a cylinder with radial cavity rotatable between a position for the support of the pasta present in said channel and a position of collection of the pasta in said radial cavity, at least one basket for the collection of the pasta output by said cylinder and a weighing device for the pasta being collected in said basket, characterised in that said cylinder is made rotate around an eccentric axis that is arranged in such a way that said cylinder when in position of support is at a higher level than the one in which it gets when in said position for the collection of the pasta.

2. Metering machine according to claim 1, characterised in that said shovel is connected with said rotation axis of the cylinder in such a way as to entirely intersect said channel when said cylinder is in the position for the collection of the pasta and to extend from the channel with the cylinder when in position for the support of the pasta.

3. Metering machine according to claim 2, characterised in that said shovel is connected with said axis of rotation of the cylinder by means of a leverage comprising a first arm connected with said axis of rotation of the cylinder and with a lever hinged to the frame of the machine, said lever being connected with a second arm connected in turn with said shovel.

4. Metering machine according to claim 1, characterised in that it comprises motor means suitable for the inclination of said shovel by a certain angle as regards a horizontal axis.

5. Metering machine according to claim 1, characterised in that said basket is connected with a weigh and during the operation of weighing of the pasta is free of any engagement with mechanisms assigned to its opening.

6. Metering machine according to claim 1, characterised in that said metering machine is a metering machine for long cut pasta.

* * * * *